United States Patent [19]

Tsuda

[11] Patent Number: 4,939,526

[45] Date of Patent: Jul. 3, 1990

[54] ANTENNA SYSTEM HAVING AZIMUTH ROTATING DIRECTIVE BEAM WITH SELECTABLE POLARIZATION

[75] Inventor: George I. Tsuda, Fullerton, Calif.

[73] Assignee: Hughes Aircraft Company, Los Angeles, Calif.

[21] Appl. No.: 289,336

[22] Filed: Dec. 22, 1988

[51] Int. Cl.[5] ..... H01Q 15/22; H01Q 19/195

[52] U.S. Cl. ..... 343/756; 343/781 R; 343/781 CA; 343/839

[58] Field of Search ..... 343/756, 761, 754, 755, 343/781 R, 840, 837, 763, 781 P, 781 CA, 909, 839

[56] References Cited

U.S. PATENT DOCUMENTS

| | | | |
|---|---|---|---|
| 3,230,537 | 1/1966 | Bartholoma | 343/756 |
| 3,943,519 | 3/1976 | Bui-Hai | 343/756 |
| 4,109,253 | 8/1978 | Chu | 343/756 |
| 4,144,535 | 3/1979 | Dragone | 343/756 |
| 4,575,726 | 3/1986 | Gounder | 343/756 |
| 4,599,623 | 7/1986 | Havkin et al. | 343/756 |
| 4,625,214 | 11/1986 | Parekh | 343/756 |
| 4,672,334 | 6/1987 | Saad | 333/21 A |

OTHER PUBLICATIONS

*Introduction to Radar Systems,* M. I. Skolnik, 2d., 1980, McGraw-Hill, pp. 242-244.

*Primary Examiner*—Michael C. Wimer
*Attorney, Agent, or Firm*—Wanda K. Denson-Low

[57] ABSTRACT

A rotating reflector is used to provide a beam scan throughout a predetermined angle such as 360°. A circular polarizer is coupled with the reflector and converts received linearly polarized energy into circularly polarized energy. A fixed feed is configured to receive the reflected circularly polarized energy and converts such energy to linearly polarized energy. The antenna system can receive the same linear polarization of energy throughout its 360° scan angle without polarization mismatch or orthogonal polarization losses. The relative orientation of the two polarizers may be adjusted to receive any orientation of linear polarization of energy throughout the scan angle. For example, they may be oriented so that the antenna system receives vertically polarized energy, slant 45° linearly polarized energy, or horizontally polarized energy.

27 Claims, 2 Drawing Sheets

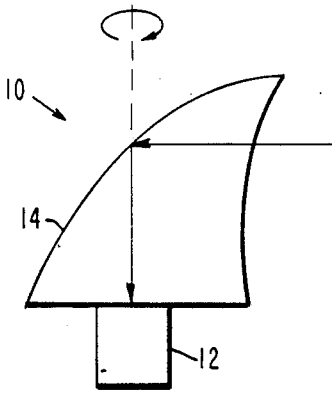
Fig. 1.
(PRIOR ART)
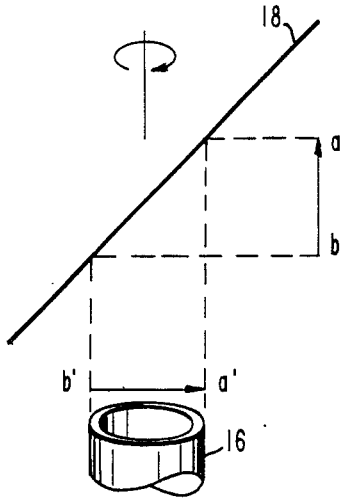
Fig. 2
(PRIOR ART)
Fig. 3.
(PRIOR ART)
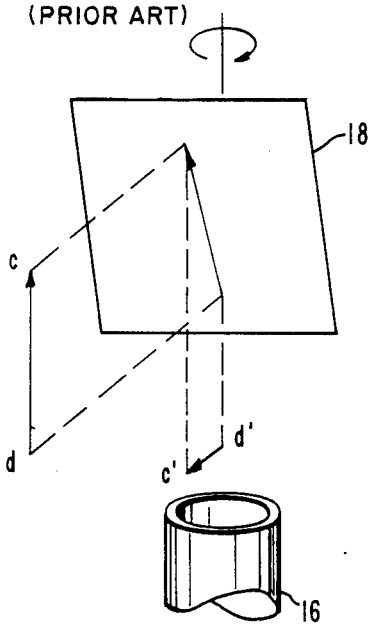
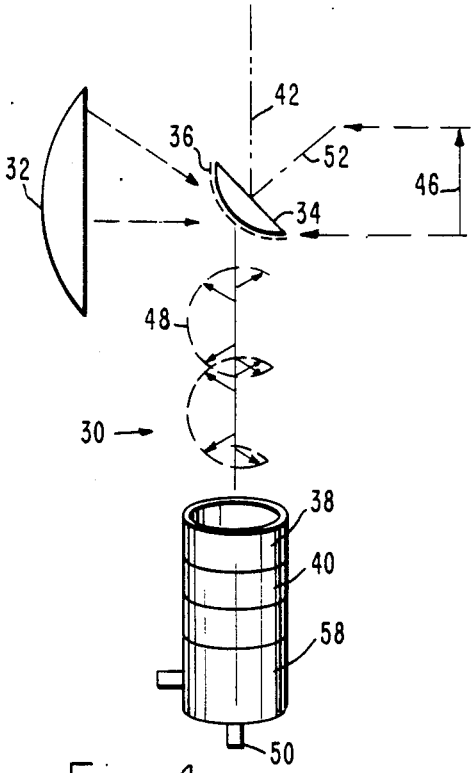
Fig. 4.

ANTENNA SYSTEM HAVING AZIMUTH ROTATING DIRECTIVE BEAM WITH SELECTABLE POLARIZATION

BACKGROUND OF THE INVENTION

The invention is related generally to antenna systems and, more particularly, to rotating directive-beam antennas with polarization control.

In many applications it is desirable to provide an antenna system capable of scanning a beam 360° in azimuth, e.g., a horizon scan. In many such applications, a rotatable antenna system is employed. Many rotatable antenna systems utilize an RF rotary joint wherein the RF feed is rotated along with the antenna. RF rotary joints have been known to be unreliable especially where the rotational speed of the antenna is substantial and where extended periods of continuous use are required. Also, rotary joints are difficult to manufacture for operation at millimeter wave frequencies.

Some antenna systems circumvent the need for an RF rotary joint by fixing the feed in place while rotating a reflector about the feed axis to provide the necessary scanning. A limitation of such systems has been that they do not provide a fixed linear polarized beam throughout the scan. As the feed remains stationary and the reflector rotates about the feed axis, the orientation of polarization varies by 90° during each 90° of rotation of the reflector. For example, the polarization may change from horizontal to vertical in the 90° of scan. Thus, for each revolution of the reflector, the polarization alternates between vertical and horizontal twice. If the feed is not circularly polarized, no energy will be received for orthogonal linear polarizations. If the feed is circularly polarized, there will be a 3 db loss of energy for linear polarizations and a complete loss if the received energy is of the opposite sense of polarization from that of the feed. If an orthomode transducer is employed at the fixed feed to capture a fixed linear polarization, the energy will switch between the ports of the transducer in dependence upon the position of the reflector. Thus, further complexities are involved in applying a switching circuit at the outputs of the transducer to conduct the desired polarization to the processor.

One method for retaining the same polarization throughout the scan is to use multiple feeds with a rotating reflector. Such a method is shown in M.I. Skolnik, *INTRODUCTION TO RADAR SYSTEMS*, 2ed., McGraw-Hill, 1980, pgs. 243–244. However, such a system requires more complexity than the single fed system, including the timing for energizing the feeds, and has a relatively large physical size and weight.

In most applications it is desirable to have an antenna system which has the same polarization as a particular target throughout its scan. For maximum received signal strength, the receive antenna should be polarized in the same manner as the signal to be received. Where the orientations of linear polarization are different, the extracted energy is reduced in proportion to the cosine of the relative angle between them. Where a circularly polarized feed is used, a loss of 3 dB is incurred due to polarization mismatch. This loss of 3 dB is significant in some applications.

Accordingly, it is desirable to provide a rotatable antenna system which avoids the problems associated with a rotary joint, which can function efficiently at millimeter wave frequencies, and which has a fixed linear polarization throughout its 360° scan.

SUMMARY OF THE INVENTION

It is an object of the invention to overcome most, if not all, of the above described problems of prior techniques by providing a rotating reflector to which is coupled a circular polarizer, the reflector and circular polarizer being fed by a fixed feed which itself includes a circular polarizer.

In the antenna system in accordance with the invention, a rotating reflector is used to provide a beam scan throughout a predetermined angle. This angle may be 360°. During a receive function, a circular polarizer employed in conjunction with the reflector functions to convert linearly polarized energy received from the beam scan into circularly polarized energy. The fixed feed of the antenna is configured to receive the reflected circularly polarized energy and convert such energy to linearly polarized energy. During a transmit function, the circular polarizer in the fixed feed converts linearly polarized energy received from the processing equipment to circularly polarized energy and feeds that energy to the reflector. The circular polarizer at the reflector then converts that energy into linearly polarized energy for transmission. By feeding only circularly polarized energy between the reflector and the fixed feed, the antenna system can equally receive the same linear polarization of energy throughout its 360° beam scan angle.

The orientation of the two circular polarizers may be adjusted in relation to each other to receive any particular linear polarization of energy throughout the beam scan angle. For example, they may be oriented so that the antenna system receives vertically polarized energy, or they may be oriented such that the antenna system receives horizontally polarized energy. The received polarization of an antenna system in accordance with the invention is thus selectable. An orthomode transducer may be attached to the feed and both polarization components of the received energy may be processed.

BRIEF DESCRIPTION OF THE DRAWINGS

The various features and advantages of the invention may be more readily understood with reference to the following detailed description taken in conjunction with the accompanying drawings in which:

FIG. 1 presents a prior art antenna system having a rotatable reflector with a circular polarization feed;

FIG. 2 presents a prior art antenna system having a rotatable reflector and a circular polarization feed and shows the reception of a vertically polarized signal;

FIG. 3 presents another view of the antenna system of FIG. 2 showing the reception of a vertically polarized signal positioned 90° away from the signal of FIG. 2;

FIG. 4 presents a schematic diagram of an antenna system in accordance with the invention;

DETAILED DESCRIPTION OF THE PREFERRED EMBODIMENT

Figure 5:
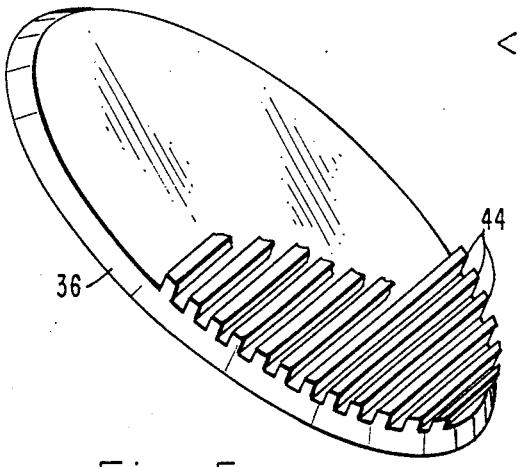
FIG. 5 presents a view of a reflection-type circular polarizer which may be used in an embodiment of the invention.

In the following description, like reference numerals will be used to refer to like or corresponding elements in the different figures of the drawings. Referring now to the drawings with more particularity, in FIG. 1 there is shown a prior art rotating reflector antenna system 10 wherein an RF feed 12 is fixed in position and the reflector 14 rotates about the feed axis. The surface of reflector 14 is shaped to provide the desired beam shape. The fixed RF feed 12 typically is configured to receive circularly polarized energy. Where linearly polarized energy is to be received by the antenna system 10, the orientation of the linearly polarized energy reflected to the fixed feed 12 by the reflector 14 will vary throughout the beam scan angle. This characteristic is described and shown in FIGS. 2 and 3.

FIG. 2 illustrates how an RF signal having vertical polarization would be reflected by a rotating reflector such that the received energy appears to have a first polarization. As shown in FIG. 2, an RF signal represented by vector "a-b" from a target is linearly polarized in the vertical direction and is reflected by the reflective surface 18. The feed 16 is fixed in position and the reflected signal appears to be polarized in relation to the feed 16 in a first direction shown by vector "a'-b'".

In FIG. 3, the reflector 18 is rotated by 90° from the position of FIG. 2 while the fixed feed 16 remains in the same position as that shown in FIG. 2. A vertically polarized RF signal represented by vector "c-d" is received from a target and is reflected such that in regard to feed 16, it appears to be polarized in a second direction, orthogonal to the first direction, as shown by vector "c'-d'". Thus, even though the signals received at the reflector 18 in FIGS. 2 and 3 are identically polarized, the signals reflected to the fixed feed 16 are 90° different in orientation.

If the reflector 18 were rotated 180° from the position shown in FIG. 3, the vector received at the feed 16 would also be polarized in the second direction, but it would be oriented 180° from vector c'-d' shown in FIG. 3. The same would apply in the case of a 180° rotation in FIG. 2. Thus, for the prior art antenna system shown in FIG. 1, the orientation of the beam in regard to feed 16 changes four times in a complete revolution. If the feed 16 were circularly polarized, a 3 dB polarization mismatch loss would be experienced. If the feed 16 were linearly polarized, the receive signal will vary sinusoidally in amplitude with a period of 2 cycles in the 360° scan.

Referring now to FIG. 4, an embodiment of an antenna system 30 in accordance with the invention is shown. The antenna system shown uses a fixed feed but does not experience the 3 dB polarization mismatch loss experienced by prior art systems. Antenna system 30 compensates for the changes in orientation of linearly polarized signals experienced by prior art systems and enables reception of fixed linearly polarized signals throughout the entire 360° scan of the antenna.

It is to be understood that the principle of reciprocity applies to the structures described herein. That is, the structures are capable of transmission as well as reception. Although described herein primarily in a reception application, this description is not meant to be limiting of the invention. The invention is capable of transmission as well, the description in terms of reception is used for purposes of convenience only.

The offset Cassegrain antenna system 30 shown in FIG. 4 comprises a first reflector 32 which is positioned to receive energy from the far field. The system 30 also comprises a second reflector 34 (subreflector) which moves with the first reflector 32 and which is positioned in relation to the first reflector 32 so that it receives reflected energy. The subreflector 34 includes a reflection-type circular polarizer 36 which circularly polarizes such reflected energy. Additionally, the antenna system 30 includes a fixed feed 38 which is a circular waveguide in this embodiment, and which includes a circular polarizer 40. The circular polarizer 40 may be implemented by a dielectric or metallic slab, buttons, squashed waveguide or other techniques well known to those skilled in the art. For further information concerning such devices, refer to R.C. Johnson and H. Jasik, *ANTENNA ENGINEERING HANDBOOK*, 2ed., McGraw-Hill, 1984, pgs. 23-20 to 23-28.

The circular polarizer 36 mounted on the subreflector 34 is located at a fixed distance from the fixed feed 38 and rotates about the feed axis 42. The first reflector 32 also rotates about the feed axis 42.

Figure 6:
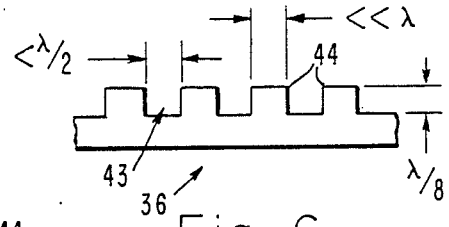
FIG. 6 presents a partial side view of the circular polarizer shown in FIG. 6.

The reflection-type circular polarizer 36 shown in FIG. 5 comprises a grooved plate or grid which is shown in more detail in FIG. 6. The distance between the fins 44 is less than $\lambda/2$ and the height of the fins 44 is approximately $\lambda/8$. The width of each fin 44 is much less than $\lambda$. Other types of circular polarizers may be used. It is meant to be understood that reference to the one shown in FIGS. 5 and 6 is not intended to limit the invention but it is specified by way of example only. For more detail concerning such devices, see R.C. Johnson and H. Jasik, *ANTENNA ENGINEERING HANDBOOK*, 2ed., McGraw-Hill, 1984, pgs. 23-25 through 23-28.

Referring again to FIG. 4, a linearly polarized signal 46 is to be received by the first reflector 32. The first reflector 32 then reflects the energy to the subreflector 34 which includes the circular polarizer 36. This polarizer 36 circularly polarizes the reflected energy and directs such circularly polarized energy 48 to the fixed feed 38. A pictorial representation of the circularly polarized energy 48 is presented in FIG. 4. The fixed feed 38 and its circular polarizer 40 operate to linearly polarize the received circularly polarized energy. Therefore, in the case where the antenna system 30 is used in a receive mode, the circular polarizer 40 in the fixed feed 38 acts to depolarize the received energy back into the linearly polarized state. In the case where the antenna system 30 is used to transmit energy, the circular polarizer 40 in the fixed feed 38 acts to circularly polarize the energy and the circular polarizer 36 at the subreflector 34 acts to depolarize that energy into a linearly polarized signal.

Thus, as described above, only circularly polarized energy is coupled between the rotating apparatus and its fixed feed. Because of this feature, the rotational position of the first reflector 32 in regard to the fixed feed 38 does not affect the orientation of the signal 50 output by the fixed feed 38 because all the like polarized signals are received at output 50. The rotational orientation of the grid polarizer 36 determines which polarization will be most efficiently processed by the antenna system 30. This relative rotation may be achieved by rotating the circular polarizer 36 mounted on the subreflector 34 about axis 52. For example, the polarizing grids on the circular polarizer 36 may be rotated 45° about the axis 52 to receive slant 45° linearly polarized signals.

It is known that by cascading the two circular polarizers 36 and 40, a rotatable linear polarizer results. The first circular polarizer may advance or delay one component of the E-field vector with respect to the other component by a selected amount, e.g., 90°. By adding the second circular polarizer, that same component may be unadvanced or undelayed or advanced or delayed an additional amount. In the case where a variable polarization antenna system were desired, means for rotating the circular polarizer 36 about its axis 52 in dependence upon the position of the first reflector 32 in its scan could be included. Both circular polarizers are of the same sense, that is, both are either right hand circularly polarized or left hand circularly polarized. In the embodiment shown in FIG. 4, the circular polarizer 36 would be oriented so that it is of the same sense as the fixed circular polarizer 40 in the feed.

Because the energy coupled between the rotating part of the antenna system and the fixed feed 38 of the antenna system is circularly polarized and because the fixed feed includes another circular polarizer which converts the energy back into its linearly polarized state, there will be no polarization mismatch loss of 3 dB as experienced in prior techniques.

The above features provide an antenna system which is unaffected by the location of the target in the scan. If, for example, it were desired to detect vertically linearly polarized targets throughout the 360° scan of the first reflector, the antenna system in accordance with the invention would output through the fixed feed 32 the same orientation for the target signal regardless of the rotational position of the first reflector 32 and subreflector 34. This occurs primarily because the energy received at the first reflector 32 is always at the same polarization with regard to the first circular polarizer 36, and that circularly polarized energy is conducted to the fixed feed 38.

Figure 7:
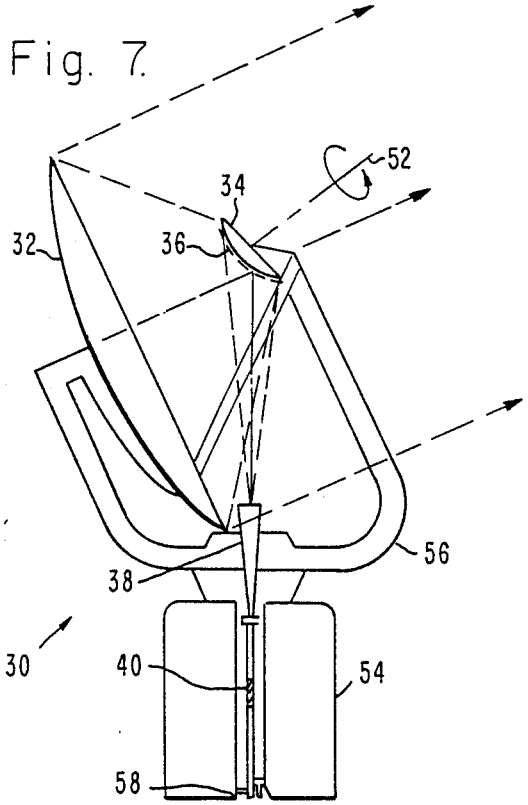
FIG. 7 presents a diagram of an offset Cassegrain type antenna system embodying the principles of the invention.

An embodiment of an antenna system 30 in accordance with the invention is shown in FIG. 7. In this embodiment, a fixed feed 38 is mounted in a housing 54. A frame 56 is rotatably mounted on the housing 54 and supports a first reflector 32 and a subreflector 34. The first reflector 32 is shaped to obtain the desired antenna gain and pattern. A reflection-type circular polarizer 36 is coupled to the subreflector 34. The fixed feed 38 comprises a circular polarizer 40 and an orthomode transducer 58 which may be used to receive orthogonal polarizations. An orthomode transducer 58 is also shown in FIG. 4.

In the case where an orthomode transducer 58 is used, the grooves 43 of the circular polarizer 36 will generally be oriented at 45° in space with respect to the orientation of linear polarization which is desired to be received. For instance, for vertical or horizontal polarization, the grooves 43 will be oriented either ±45° from vertical depending on what port of the orthomode transducer is used or what sense of circular the circular polarizer 40 is. If an orthomode transducer is used, then one port will receive vertical polarized signals and the orthogonal port will receive horizontal polarized signals. If the polarizing grooves 43 are orientated vertically or horizontally, the receive signal will be matched to slant ±45° linear depending on the orthomode transducer ports.

In another embodiment of the invention, a circular polarizer may be mounted on the first reflector 32, rather than at the subreflector 34.

In yet another embodiment of the invention, a single reflector antenna system may be used. This single reflector may have the first circular polarizer mounted on it. This reflector would be shaped to provide the desired beam shape.

Figure 8:
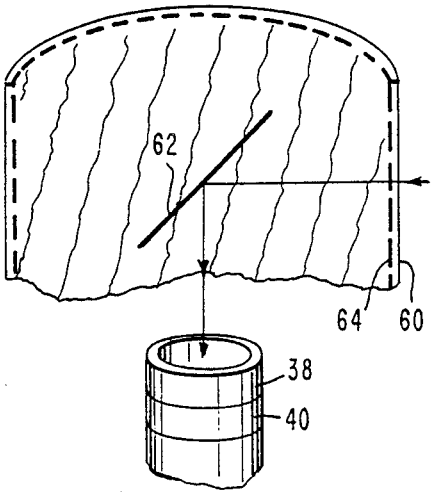
FIG. 8 presents a further embodiment of an antenna system in accordance with the invention wherein the radome contains a transmissive-type circular polarizer.

Another embodiment is shown schematically in FIG. 8. In this embodiment, a radome 60 surrounds the reflector 62. Mounted in the radome 60 is a transmission-type circular polarizer 64, such as a meander line (for more detail on such circular polarizers, refer to R.C. Johnson and H. Jasik, *ANTENNA ENGINEERING HANDBOOK*2ed., McGraw-Hill, 1984pgs. 46-10 through 45-14). The circularly polarized energy received at the reflector 62 from the radome 60 is reflected to the fixed feed 38 which includes a circular polarizer 40.

Thus, there has been shown and described a new and useful antenna system capable of providing a beam scan without the use of a rotary joint. The antenna system is capable of efficiently processing a selected linear polarization of energy throughout a 360° beam scan angle with a fixed feed without experiencing loss of power due to orthogonal polarizations or polarization mismatches.

Although the invention has been described and illustrated in detail, this is by way of example only and is not meant to be taken by way of limitation. Modifications to the above description and illustrations of the invention may occur to those skilled in the art, however, it is the intention that the scope of the invention should include such modifications unless specifically limited by the claims.

What is claimed is:

1. A scanning antenna system for processing linearly polarized signals, the system providing a beam scannable through a predetermined scan angle, the system comprising:

reflector means rotatable about an axis for scanning the beam, for forming the beam, for reflecting energy of the beam and for reflecting energy along the axis, and comprising a first circular polarizer for polarizing the energy processed by the reflector means;

a fixed feed which is non-rotating about the axis and which has a first port disposed along the axis and fixed in position in relation thereto for feeding circularly polarized energy along the axis between its first port and the reflector means, and having a second port through which linearly polarized energy is fed; and a second circular polarizer disposed in the fixed feed for polarizing the energy traversing the first and second ports of the fixed feed, the second circular polarizer having the same sense of polarization as the first circular polarizer.

2. The antenna system of claim 1 wherein the first circular polarizer is disposed such that it intersects the axis.

3. The antenna system of claim 2 wherein the first circular polarizer is mounted on the reflector means.

4. The antenna system of claim 3 wherein the reflector means comprises a first reflector having a shape selected to achieve the desired beam shape and a subreflector disposed such that it intercepts the axis and rotates about the axis with the first reflector.

5. The antenna system of claim 4 wherein the first circular polarizer is mounted on the subreflector.

6. The antenna system of claim 5 wherein the first circular polarizer comprises a reflection-type circular polarizer.

7. The antenna system of claim 5 wherein the fixed feed comprises an orthomode transducer for feeding orthogonal polarizations of linearly polarized energy.

8. The antenna system of claim 1 wherein the first circular polarizer is disposed so that it operates on the beam energy before it is reflected along the axis by the reflector means.

9. The antenna system of claim 8 wherein the first circular polarizer is disposed such that it surrounds the reflector means through the beam scan angle.

10. The antenna system of claim 9 further comprising a radome surrounding the reflector means, the first circular polarizer being disposed in the radome.

11. The antenna system of claim 1 wherein the first circular polarizer is disposed so that it operates on the beam energy after it has been reflected from along the axis by the reflector means.

12. The antenna system of claim 11 wherein the first circular polarizer is disposed such that it surrounds the reflector means through the beam scan angle.

13. The antenna system of claim 12 further comprising a radome surrounding the reflector means, the first circular polarizer being disposed in the radome.

14. A scanning antenna system for processing linearly polarized signals, the system providing a beam scannable through a predetermined scan angle, the system comprising:

reflector means rotatable about an axis for scanning teh beam, for forming the beam, for receiving energyof the beam and for reflecting the received energy of the beam along the axis, and comprising a first circular polarizer for circularly polarizing energy which is reflected along the axis by the reflector means;

a fixed feed which is non-rotating about the axis and which has a first port and a second port, the first port being disposed along the axis and fixed in position in relation thereto forreceiving the circularly polarized energy reflected along the axis by the reflector means, the fixed feed comprising a second circular polarizer for linearly polarizing the energy received from along the axis, the second circular polarizer having the same sense of polarization as the first circular polarizer, and the fixed feed feeding the linearly polarized energy from the second circular polarizer out of the second port.

15. The antenna system of claim 14 wherein the reflector means comprises a first reflector having a shape selected to achieve the desired beam shape and a subreflector disposed such that it intercepts the axis and rotates aboutthe axis with the first reflector and having the first circular polarizer mounted on the subreflector.

16. The antenna system of claim 15 wherein the first circular polarizer comprises a reflection-type circular polarizer.

17. The antenna system of claim 14 wherein the fixed feed comprises an orthomode transducer for feeding orthogonal polarizations of linearly polarized energy.

18. A scanning antenna system for processing linearly polarized signals, the system providing a beam scannable through a predetermined scan angle, the system comprising:

a fixed feed having a first port and a second port, the second port being disposed along an axis and fixed in position in relation thereto, teh fixed feed for receiving linearly polarized energy through the first port, the fixed feed comprising a first circular polarizer for circularly polarizing the linearly polarized energy received through the first port, the fixed feed feeding such circularly polarized energy out the second port along the axis;

reflector means rotatable about the axis for receiving circularly polarized energy from along the axis, reflecting the circularly polarized energy into the beam, scanning the beam, and comprising a second circular polarizer for linearly polarizing the circularly polarized energy which is received from along the axis, the second circular polarizer having the same sense of polarization as the first circular polarizer; and the fixed feed being disposed such that it is non-rotating about the axis.

19. The antenna system of claim 18 wherein the reflector means comprises a first reflector having a shape selected to achieve the desired beam shape and a subreflector disposed such that it intercepts the axis and rotates about the axis with the first reflector and having the second circular polarizer mounted on the subreflector.

20. The antenna system of claim 19 wherein the first circular polarizer comprises a reflection-type circular polarizer.

21. A scanning antenna system comprising:

reflector means rotatable about an axis for forming a beam, for scanning the beam, for reflecting energy of the beam and for reflecting energy along the axis, and comprising a first circular polarizer for polarizing the energy processed by the reflector means;

a fixed feed which is non-rotating about the axis and which has a first port disposed along the axis for feeding circularly polarized energy along the axis between the first port and the reflector means, and having a second port through which linearly polarized energy is fed; and a second circular polarizer coupled to the fixed feed for polarizing the energy traversing the first and second ports of the fixed feed, the second circular polarizer having the same sense of polarization as the first circular polarizer.

22. The antenna system of claim 21 wherein:

the first circular polarizer energy which is linearly polarized and is received by the reflector means, the circularly polarized energy is then fed along the axis;

the second circular polarizer linearly polarizes the circularly polarized energy received from along the axis through the first port of the fixed feed; and the linearly polarized energy is output through the second port of the fixed feed.

23. The antenna system of claim 22 wherein the reflector means comprises a first reflector having a shape selected to achieve the desired beam shape and a subreflector on which is disposed the first circular polarizer, the subreflector being disposed such that it intercepts the axis and rotates about the axis with the first reflector.

24. The antenna system of claim 23 wherein the first circular polarizer comprises a reflection-type circular polarizer.

25. The antenna system of claim 21 wherein:

the second circular polarizer circularly polarizes energy which is linearly polarized and is received through the second port of the fixed feed;

the fixed feed outputs the circularly polarized energy along the axis; and the circularly polarized energy fed along the axis is received by the reflector means and fed to the first circular polarizer which linearly polarizes the energy.

26. The antenna system of claim 21 wherein the reflector is continuously rotatable about the axis through 360 degrees.

27. The antenna system of claim 21 wherein the fixed feed comprises an orthomode transducer for feeding orthogonal polarizations of linearly polarized energy.

* * * * *